US005771767A

United States Patent [19]

Itami

[11] Patent Number: 5,771,767

[45] Date of Patent: Jun. 30, 1998

[54] ANGLE ATTACHMENT FOR WOODWORKING TOOLS

[76] Inventor: Steven D. Itami, 15618 N. 54th Pl., Scottsdale, Ariz. 85254

[21] Appl. No.: 717,366

[22] Filed: Sep. 23, 1996

[51] Int. Cl.[6] ..... B27B 25/10; B27B 27/06

[52] U.S. Cl. ..... 83/435.13; 83/435.14; 83/468.3; 83/477.2; 83/522.18; 83/581; 33/459; 33/464; 144/216

[58] Field of Search ..... 83/435.12, 435.14, 83/435.15, 437.2, 468.3, 522.18, 581, 421, 437.1, 477.2, 435.13; 33/456, 459, 460, 463, 464, 640, 641; 144/216

[56] References Cited

U.S. PATENT DOCUMENTS

| | | | |
|---|---|---|---|
| 1,640,604 | 8/1927 | Hauber | 33/463 |
| 2,968,325 | 1/1961 | Wandvik | 83/435.14 |
| 3,263,714 | 8/1966 | Martinson | 30/286 |
| 3,738,211 | 6/1973 | Carter, Sr. | 83/468 |
| 4,024,783 | 5/1977 | Sturgis | 83/468 |
| 4,167,883 | 9/1979 | Hedstrom | 83/581 X |
| 4,741,387 | 5/1988 | Strong | 83/435.14 X |
| 5,016,508 | 5/1991 | Hallenbeck | 83/435.13 |
| 5,042,346 | 8/1991 | McCann | 83/468.3 X |
| 5,379,669 | 1/1995 | Roedig | 83/435.14 X |
| 5,384,967 | 1/1995 | Helmuth | 33/463 X |
| 5,414,938 | 5/1995 | Meek | 33/464 X |
| 5,603,164 | 2/1997 | Haddix | 83/522.18 X |

*Primary Examiner*—Eugenia Jones
*Attorney, Agent, or Firm*—Jeffrey D. Moy; Allen J. Moss; Harry M. Weiss & Associates, P.C.

[57] ABSTRACT

A miter attachment capable of use on radial saws, table saws, drill presses, router tables, and the like, comprises three legs of a triangle. The longest leg constitutes an elongated base member. This base member is pivotally attached at one end to a fence member. The base member has a track in it for engagement by a slider, which is capable of movement along at least a portion of the length of the base member. The slider is pivotally attached to one end of a coupler arm, the other end of which is pivotally attached to the fence member at a point spaced from the end pivotally attached to the base member. As the slider is moved to different relative positions along the length of the base member, the coupler arm causes the angle between the fence and the base member to change.

20 Claims, 3 Drawing Sheets

SAWBLADE ANGLE ADJUSTMENT

ANGLE ATTACHMENT FOR WOODWORKING TOOLS

BACKGROUND OF THE INVENTION

1. Field of the Invention

This invention relates to woodworking tools and, more specifically, to an easily adjustable, lightweight angle attachment for use with a variety of different power tools.

2. Description of the Prior Art

Woodworking tools, such as table saws, radial arm saws, drill presses, routers, jigsaws and the like frequently require cuts or other woodworking operations to take place on a piece of wood at various angles. Miter accessories have been developed for use with at least some of these tools. For table saws, some such miter accessories have been developed in the form of protractor-like attachments, typically placed on a guide bar, which moves in a machined slot on the table saw top or the like. A fence assembly is attached to the protractor apparatus to set the fence to various angles. A lock knob generally holds the fence in position. Some miter gauges of this type include built-in stops for permitting quick setting to the more commonly used angles. Additional accessories in the form of extensions on the fence, with movable stop members on them, are available to permit the cutting of multiple pieces of wood to the same lengths. Protractor miter gauges generally are relatively small (typically, having a radius of 6 inches to 10 inches or so), so that care must be taken to accurately position the fence for achieving the miter cuts desired. Since miter gauges of this type require a machined slot on the table saw top or router table top, they also are not suitable for tools which do not typically include a movable fence, such as radial arm saws and drills.

In addition to the relatively limited use which may be achieved by standard protractor-like miter gauges, such gauges also are relatively expensive, since they require a precision protractor, along with various configurations of fences and the like. Also, most protractor type miter gauges include several different parts, all of which must be accurately assembled together and accurately machined if the miter gauge is to be used in any type of precision work.

The McCann U.S. Pat. No. 5,042,346 is directed to a fixture for attachment to a protractor-like miter gauge providing an accurate 45° angled fence surface for use with a table saw. The fixture of this patent, however, is incapable of any adjustment in and of itself; and if angles other than 45° are to be cut using the fixture, a protractor type miter gauge, of the type described above, also must be employed. All of the disadvantages which are discussed above in conjunction with protractor type miter gauges are present in the device disclosed in the McCann patent.

The Sturgis U.S. Pat. No. 4,024,783 is directed to a fence attachment for radial arm power saws, to provide adjustable fences on either side of the path of the saw blade for permitting angled cuts to be made by the saw. The fences are attached to a table-like support member, which is located beneath the path of travel of the saw. The support member includes pivotal adjustments for the fences, which rotate in a generally circular path to provide the desired cutting angles for the work pieces held against them. Separate fences are provided on opposite sides of the cutting path of the saw blade. The device of the Sturgis patent is a relatively cumbersome and somewhat complex device, which typically replaces the table top of the saw with which it is used, and becomes a permanent part of the power saw apparatus.

Carter U.S. Pat. No. 3,738,211 is directed to an adjustable saw guide for a hand-held portable saw to permit cuts at various angles to be effected for making rafter cuts and the like. The saw guide of this patent is not suited for table mounted tools such as table saws, radial arm saws, drill presses and the like.

In efforts to overcome the disadvantages of protractor type miter gauges, miter gauges, which are capable of achieving greater accuracy, have been developed in the form of sliding tables for use with table saws. These tables typically consist of a platform, which slides on the table saw top on guide bars which ride in the miter slots of the table saw. The top of the sliding table then has a fence, which is pivoted to different angles. An advantage of a sliding table is that the table platform lifts the stock or work piece off the saw table; so that there is a reduction in the friction and creep between the saw table and the work piece. At the same time, the thickness of the sliding table itself reduces the depth of the cut which may be made. For stock which has a thickness already approaching the maximum depth of the cut which can be made, this can constitute a serious disadvantage.

Hallenbeck U.S. Pat. No. 5,016,508 discloses a typical type of a sliding table or moving table miter gauge for a table saw. The miter gauge of the Hallenbeck patent uses the table surface itself as one of two fixed length legs of a triangle. The other fixed length leg constitutes the fence, against which the stock is placed for the cutting operation. The third leg is formed as a gauge bar, which has a number of holes in it to adjust the position of the fence corresponding to different angles determined by the hole positions. A locating pin is inserted through one of the holes at an anchor block to adjust the angle of the fence. The device of this patent necessarily is usable only with the table saw for which it is designed. It also operates on one side of the saw blade only; so that complementary cuts require repositioning of the fence whenever they are to be made.

It is desirable to provide an angle attachment for power tools, which is capable of operation with a number of different tools, which is simple in construction, easy to use, portable and accurate.

SUMMARY OF THE INVENTION

In accordance with one embodiment of the present invention, it is an object of the present invention to provide an improved angle attachment for power tools.

It is another object of the present invention to provide an improved angle attachment capable of use with a variety of different power tools.

It is still another object of the present invention to provide an improved portable miter gauge attachment for use with different types of power tools.

It is a further object of the present invention to provide an easily adjustable, portable, lightweight angle attachment for use with various types of power tools.

BRIEF DESCRIPTION OF THE PREFERRED EMBODIMENTS

In accordance with one embodiment of the present invention, a miter attachment for use with power tools, such as radial arm saws, table saws, drill presses, jigsaws, routers and the like, is constructed in the form of a three-piece triangular unit, in which the different legs of the triangle are hinged together. One of the legs comprises an elongated base member, which is hinged at one end to an end of an elongated fence. The other end of the fence is pivotally hinged to one end of a coupler arm. The other end of the coupler arm is attached to a slider, which is moved to different positions on the base member. As the slider is moved to different positions, the angle between the base member and the fence is adjusted. The base member is attached to the tool to provide a proper reference or orientation for the fence in the use of the tool.

The foregoing and other objects, features, and advantages of the invention will be apparent from the following, more particular, description of the preferred embodiments of the invention, as illustrated in the accompanying drawings.

DETAILED DESCRIPTION OF THE PREFERRED EMBODIMENT

Reference now should be made to the drawings, in which the same reference numbers are used throughout the different figures to designate the same components. FIG. 1, 2, 9 and 10 all show an angle attachment for use on various power tools. As illustrated in these figures, the invention is shown used in conjunction with a table saw and a radial arm saw. The miter angle attachment which is illustrated, however, also may be used on drill presses, router tables, jigsaws and other tools where establishment of a cutting angle or a working angle for the tool is desired.

Figures 1, 3, 4, 5:
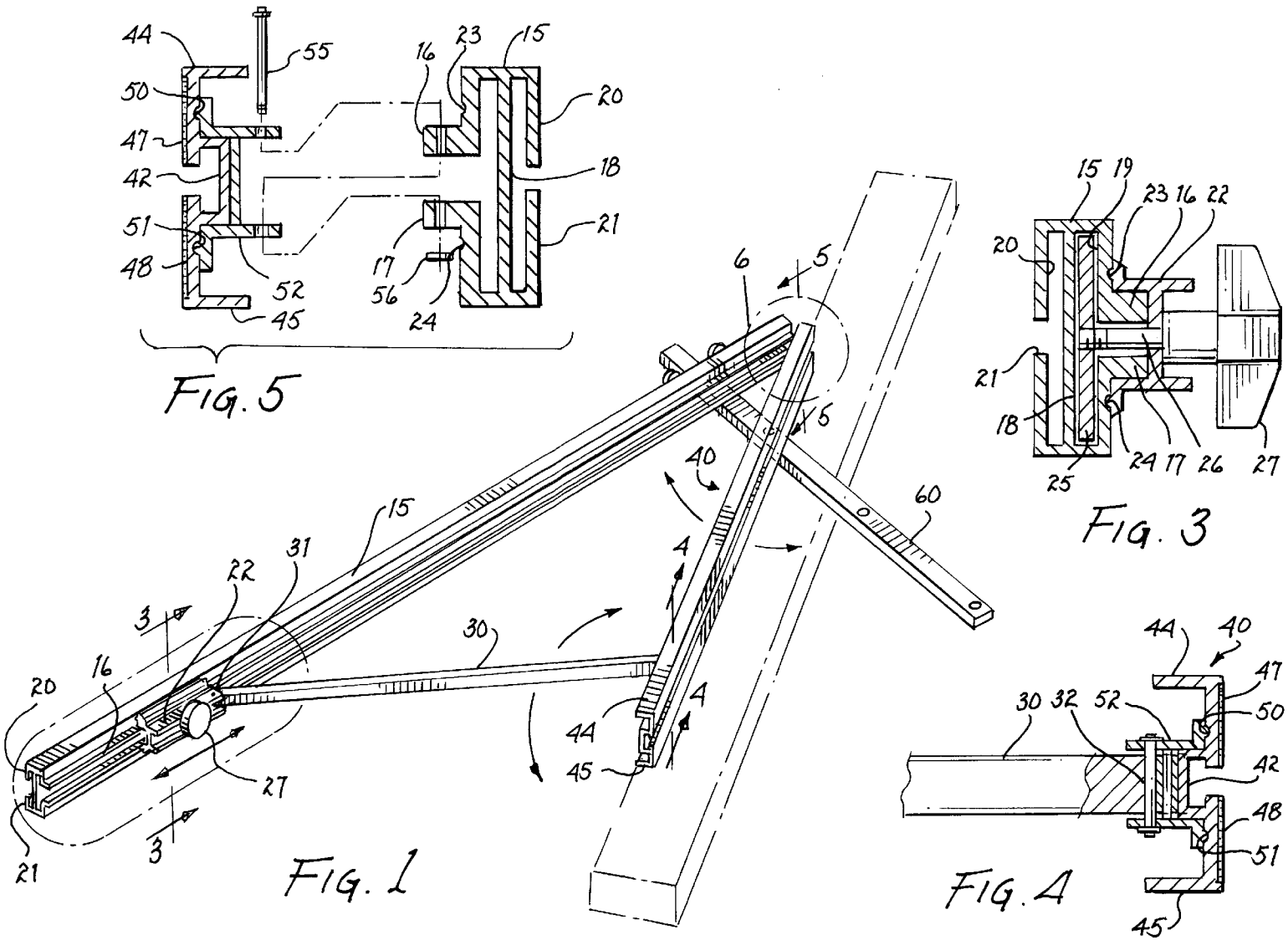
FIG. 1 is a perspective view of a preferred embodiment of an angle attachment for a tool according to the present invention.
FIG. 3 is a cross-sectional view taken along the line 3—3 of FIG. 1.
FIG. 4 is a cross-sectional view taken along the line 4—4 of FIG. 1.
FIG. 5 is a partially exploded cross-sectional view taken along the line 5—5 of FIG. 1.

The attachment includes an elongated base 15, which preferably is made of extruded aluminum, although other material may be used. The cross-sectional configuration of the base 15 is uniform throughout its length; and this cross-sectional configuration is shown in FIGS. 3 and 5. The tool is constructed in the form of a triangle. The base 15 is one leg; a second leg comprises a fence 40; and the third leg comprises a coupler arm 30. Different angular configurations of these three legs 15, 40 and 30 readily are ascertainable from an examination of FIGS. 1, 2, 9 and 10.

The base 15 has a central vertical rib 18 extending throughout its length. On the left side of the rib, as viewed in FIGS. 1 and 3, a pair of inwardly turned flanges 20 and 21 define a narrow slot for accommodating a table saw push plate. On the opposite side of the rib 18, a pair of outwardly protruding extensions 16 and 17 define a narrow slot between them. This slot opens into an elongated narrow rectangular channel 19. Immediately adjacent the bases of the extensions 16 and 17, are a pair of semi-circular elongated tracks or grooves 23 and 24, which also extend the length of the member 15.

To provide for the adjustable angle operation of the tool, a slider 22 (in a generally "H-shaped" configuration), made of a short length of extruded material, also preferably aluminum, closely fits over the outside of the extensions 16 and 17, as illustrated most clearly in FIG. 3. The slider 22 also has some semi-circular projections on the ends of the "H" which abuts the outer surface of the base 15 to mate in the semi-circular grooves on the base 15. These grooves and the extensions 16 and 17 function as a guide or track for the slider 22.

A rectangular plate 25 is placed in the channel 19, as illustrated in FIG. 3. The plate 25 has a threaded hole in its center for receiving a shaft 26 threaded at its left-hand end, as viewed in FIG. 3. The shaft 26 passes through a hole in the center of the slider 22 and is connected to a knob 27, which has an enlarged shoulder for engaging the slider 22. When the knob 27 is turned counter clockwise to release the plate 25, the slider 22 may be moved to any longitudinal position along the member 15 from one end to another within the constraints of the relative lengths of the fence 40 and the coupler arm.

Figure 2:
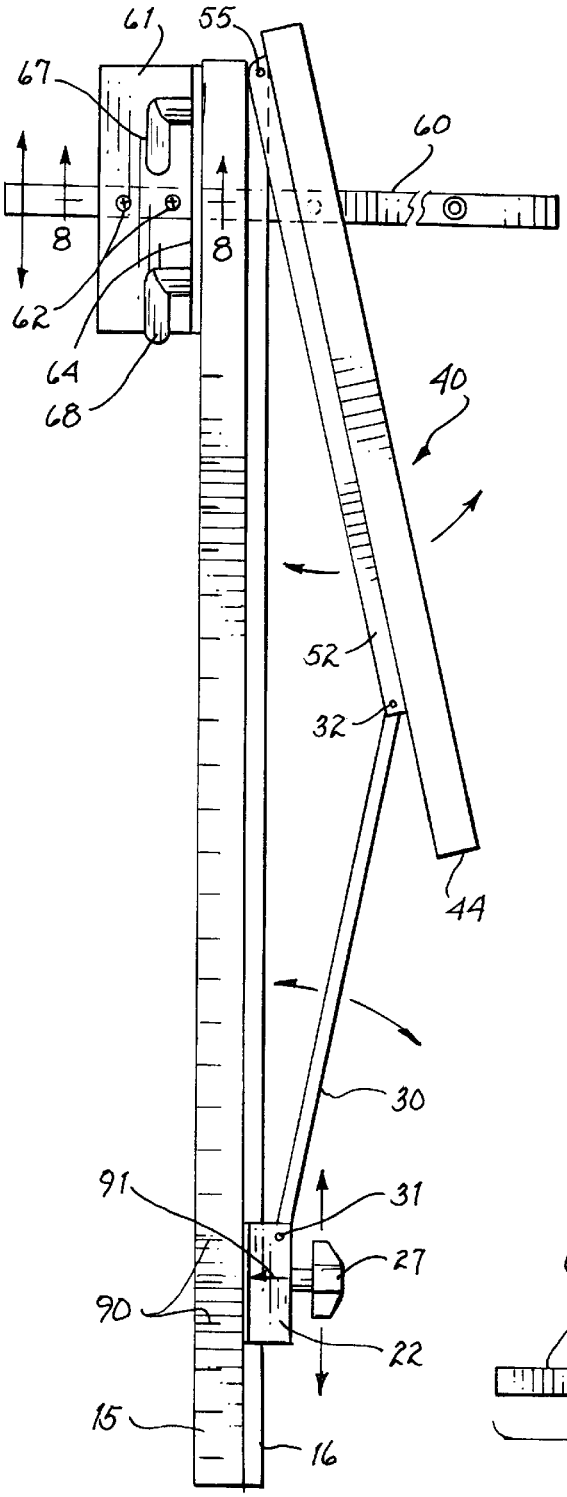
FIG. 2 is a top view of the embodiment shown in FIG. 1.
Figure 6:
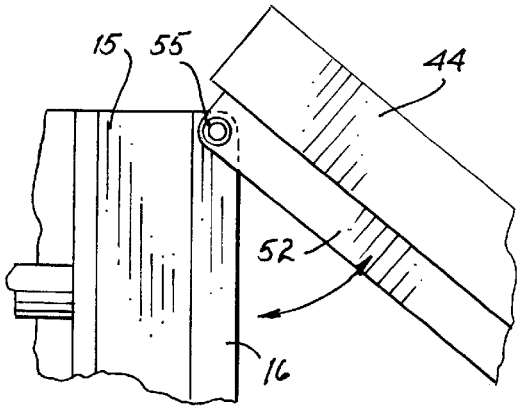
FIG. 6 is a top view of the enlarged portion circled with the number 6 in FIG. 1.

The three elongated members 15, 30 and 40 are connected together by means of pivot pins or hinge pins 31, 32 and 55, as illustrated most clearly in FIG. 2. Details of the hinge pin connections for the pins 32 and 55 are shown in FIGS. 4 and 5, respectively. The angled fence 40 is illustrated in cross section in FIG. 4, which also shows the manner of connection of this fence with the right-hand end of the coupler arm 30, by means of the hinge pin 32. As shown, the fence 40 has upper and lower inwardly turned flanges 44 and 45, which are perpendicular to the vertical material engaging face of the fence 40. An inner channel 42 extends along the front face of the channel 40, with upper and lower portions of the material engaging surface of the fence defining a narrow slot in communication with the channel 42. This channel 42 may be used to accommodate a material stop (not shown), which is secured at different longitudinal positions of the fence 40 much in the same manner of the movement of the slider 22, which is shown in FIG. 3, and which has been described above.

The inner or left-hand side of the fence 40, as viewed in FIGS. 2 and 4, has an elongated "H-shaped channel 52 extending throughout the major portion of its length. The cross-sectional configuration of the channel 52 is identical to the cross-sectional configuration of the slider 22; so that these parts may be made from the same extrusion. The "H-shaped" member 52 may be secured to the fence 40 by any suitable means, such as by threaded fasteners located within the channel 42, brazing, suitable adhesives, or the like. A tight bond between the cross member of the "H-shaped" member 52 and the flat vertical exterior portion of the channel 42 may be used to achieve this bond, as illustrated in FIGS. 4 and 5. It should be noted that semi-circular grooves 50 and 51 are provided along the length of the fence 40 for accommodating the corresponding semi-circular shaped ribs on the ends of the member 52, much in the same manner that the similar parts of the slider 22 fit within the elongated grooves 23 and 24 of the base member 15.

Once the hinge pins 32 and 55 are inserted to secure the parts together, as shown in FIGS. 4 and 5, suitable cotter keys, lock washers or the like are used to hold the pins 32 and 55 in place. A similar arrangement is used for securing the left-hand end of the coupler arm 30 in the slider 22 with the hinge pin 31.

It is readily apparent that when the knob 27 is loosened to allow free longitudinal movement of the slider 22 back-and-forth in the direction of the arrows shown in FIGS. 1 and 2, various angles between the base member 15 and fence 40 may be achieved by pivoting these two parts on the hinge pin 55 at the upper ends of these elements, as viewed in FIGS. 1 and 2.

As shown in FIG. 2, the base member 15 preferably includes indicia marks 90 along its length; and the slider includes an arrow or other indicia 91 on it. To establish any one of the various angles to which the device may be set from 0° to 90°, the pointer 91 on the slider 22 is located opposite an appropriately labeled indicia 90 on the member 15. When the desired angle is indicated, the knob 27 is turned clockwise to tighten the slider 22 in the slot 19 to cause the triangle formed by the member 15, fence 40 and coupler arm 30 to become a rigid triangle. The desired angle then is established between the face of the fence 40 and the base member 15.

To use the tool on a table saw, a guide bar 60, having a width and depth selected to fit within the guide slot on the top of the table saw table, is attached to the lower surface 61 of an L-shaped push member 61/64 by means of a pair of threaded fasteners 62. A vertical plate 64 of the L-shaped member 61/64 then has a pair of spaced holes located in it in alignment with the slot formed between the ends of the inwardly-turned flanges 20 and 21 of the member 15. A rectangular plate 69 is placed within the cavity formed between the rib 18 and the flanges 20 and 21. The plate 69 has a pair of threaded holes in it for receiving the threaded ends of a pair of rotatable handles 67 and 68, which are inserted through the holes in the plate 64 and the slot between the flanges 20 and 21, to engage the threaded openings in the plate 69.

When the handles 67 and 68 are turned in a counter clockwise direction to loosen the plate 69, the member 15 may be moved relative to the surface 64 in the direction of the arrows to locate the member 61/64 at any desired position along the length of the base member 15. When the desired position is reached, the handles 67 and 68 are tightened to pull the plate 69 toward the left, as viewed in FIG. 8, to clamp it against the inside surfaces of the flanges 20 and 21 to hold the entire assembly together in a rigid fashion. The device assembled in this manner then may be used on a table saw, as viewed in FIG. 9, with the stock or work piece 80 held against the face of the fence 40 to make cuts by a blade 71 at the desired angle established by the position of the pointer 91 opposite the desired indicia 90.

To increase the friction, and therefore reduce the chances of a work piece or stock from sliding along the fence 40, the vertical faces of the fence 40 between the support flanges 44 and 45 are covered with a roughened or abrasive surface. This surface preferably is provided by anti-skid tape 47 and 48 secured to the upper and lower vertical faces, respectively, as illustrated most clearly in FIG. 4.

Figure 9:
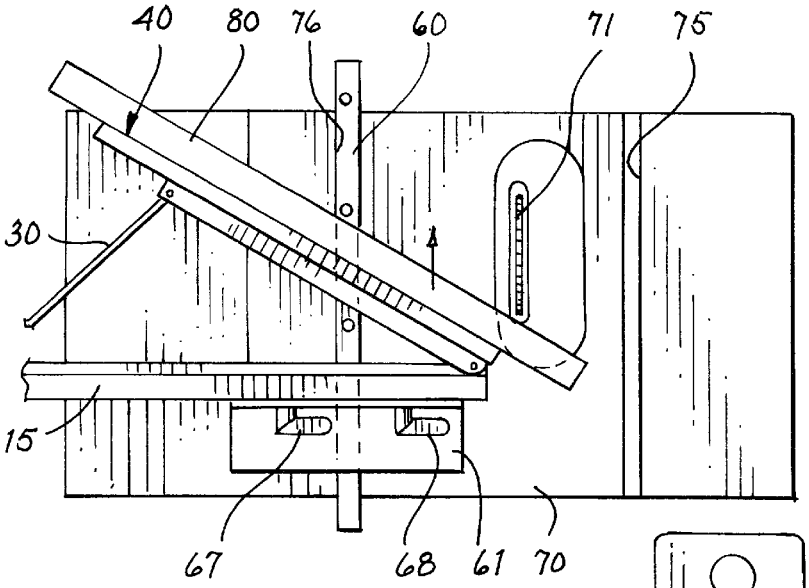
FIG. 9 is a top view of the apparatus of FIG. 1 through 8 showing the manner of use with a table saw.

The arrangement which is shown in FIGS. 1 and 9, using the slider bar 60, is suitable for use with any tool having a guide groove 75 or 76 in it (FIG. 9) for receiving the bar 60. This includes table saws, bench routers, drill presses and the like.

Figure 7:
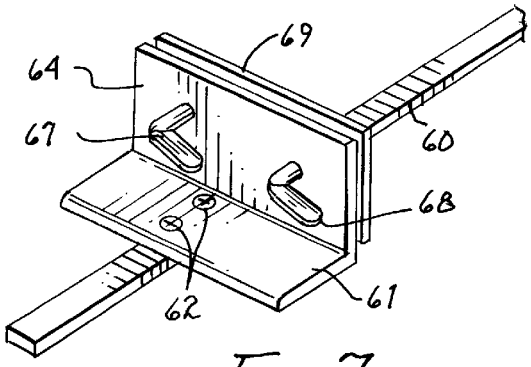
FIG. 7 is a perspective view of a detail of an accessory used in conjunction with the embodiment shown in FIG. 1.
Figure 8:
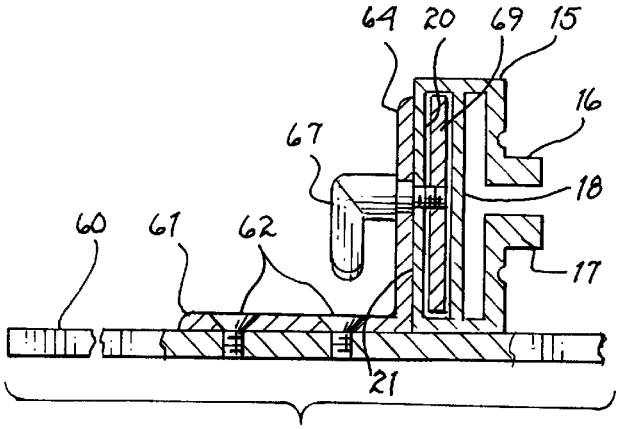
FIG. 8 is a cross-sectional view of the device shown in FIGS. 7 and 1, illustrating details of a manner of use of the accessory of FIG. 7.
Figure 10:
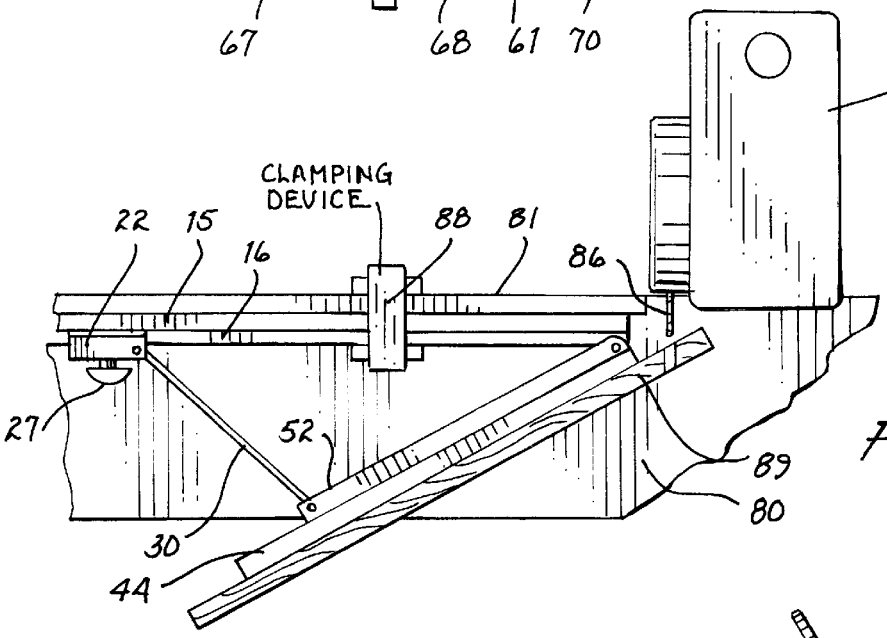
FIG. 10 is a top view of the device of FIG. 1, showing the manner of use with a radial arm saw.

To use the angle attachment with a radial arm saw, the base member 15 is clamped by means of a conventional C-clamp 88, spring clamp or the like to the rear fence 81 of the table surface located below the radial arm saw 85, having a blade 86. This is illustrated in FIG. 10. When this is done, the apparatus shown in FIGS. 7 and 8 is not used, since it is not necessary. It is readily apparent, however, that removal of the device 61/64 and the inner plate 69, is a relatively simple matter, since the entire unit simply may be withdrawn by sliding it beyond either end of the base member 15, when the handles 67 and 68 are turned counter clockwise to loosen the plate 69.

When the angle attachment of FIGS. 1 and 10 is used in conjunction with a radial arm saw, no modification whatsoever to the standard functionality of the radial arm saw 85/86 is required. All that is necessary is for the clamp 88 to releaseably secure the base member 15 to the existing fence 81 of the radial arm saw. When the saw blade 86 is moved along its normal cut line from the front of the table 80 to the rear (from bottom to top as viewed in FIG. 10), the desired angle cut is formed in the work piece 89 in accordance with the angle setting produced in the manner described above.

It should be noted that an identical opposing miter can be cut by moving the tool to the opposite side of the blade 86 (FIG. 10) or 71 (FIG. 9), simply by flipping the device on its opposite surface. For example, as indicated in FIGS. 1, 2, 9 and 10, the device rests with the surface 45 on the support surface or table 70 or 80. To place it on the opposite side of the blades 71 and 86 to cut angles on the opposite sides, the device simply is flipped over to rest on the flange 44, which now becomes the flange resting on the table top 70 or 80, with the flange 45 being in the uppermost or top position.

Since all of the parts are made of extruded aluminum, the angle attachment which is shown and described easily may be transported from place to place, and readily may be set up and adjusted on a variety of different tools.

Figure 11:
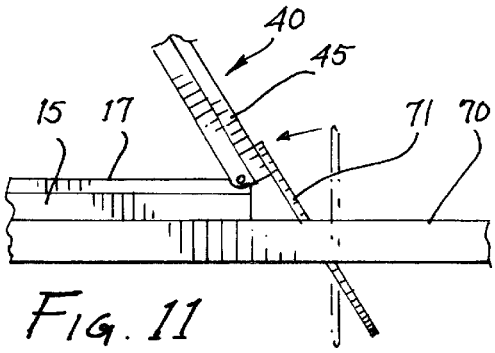
FIG. 11 is a partially broken-away view of the device of FIG. 1, illustrating an alternative use.
Figure 12:
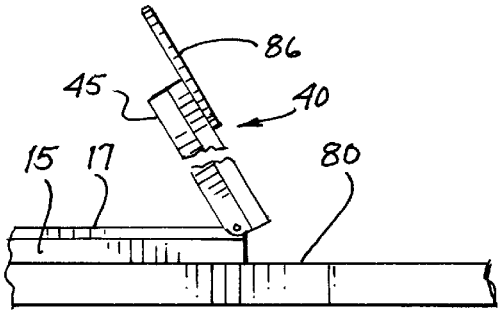
FIG. 12 is a partially broken-away view of the device of FIG. 1, showing an additional manner of use.

It also is possible to use the angle attachment, which is shown in FIGS. 1 and 2, as a saw blade angle adjustment. To do this, the tool is placed so that the inwardly turned flanges 20 and 21 of the base member 15 rest on the saw support surface (for a table saw), as shown in FIG. 11. The angle of tilt of the blade 71 then is adjusted in the same manner described above, and the plane of the blade 71 is caused to rest on the surface of the fence 40, as illustrated in FIG. 11. Once the desired angle of tilt for the blade 71 is achieved, the blade is tightened at this angle. The angle attachment then is removed, and the table saw 70/71 may be used in its normal manner.

A similar adjustment of the angle of the blade 86 of the radial arm saw 85 also may be effected with the angle attachment. Again, when this is done, the faces of the flanges 20 and 21 are placed on the table 80 for the radial arm saw. The desired angle between the base member 15 and the fence 40 is established. The blade 86 of the saw 85 is loosened to place the blade against the fence 40 at the desired angle. Once that desired angle has been established, the blade 86 is tightened, and the radial arm saw 85 then may be used to make the desired angled cuts.

The foregoing description of the preferred embodiment of the invention should be considered as illustrative, and not as limiting. The specific materials which have been described may be replaced with other suitable materials, if desired. Different types of pivots, other than the pin-type pivots or hinges which have been illustrated, may be used if desired. For some angles, pre-set detents may be used if desired. Different techniques may be used for tightening the slider 22 other than the one shown. Various other changes and modifications will occur to those skilled in the art, without departing from the true scope of the invention as defined in the appended claims.

What is claimed is:

1. An angle attachment for use with a plurality of different tools comprising in combination:

an elongated base member having first and second ends and having a first track thereon formed by a pair of outwardly protruding extensions which extend substantially along the entire length thereof;

a fence member having a flat material-engaging surface thereon and having first and second ends wherein said first end of said fence member is pivotally coupled to said first end of said base member;

a slider member on top of said pair of outwardly protruding extensions and engaging the first track of said base member for movement between said first and second ends of said base member substantially along the entire length thereof; and coupler arm means having first and second ends wherein the first end is pivotally coupled to said slider member and the second end is pivotally coupled to said fence member a predetermined distance from said second end of said fence member for setting said fence member to a desired angle relative to said base member when said slider member is moved.

2. The combination according to claim 1 wherein said slider member matingly engages the first track on said elongated base member.

3. The combination according to claim 2 further comprising means coupled with said slider member for releaseably securing said slider member at different predetermined positions on the first track on said elongated base member, thereby changing the angle of said fence member relative to said elongated base member.

4. The combination according to claim 3 wherein said flat material-engaging surface of said fence member is perpendicular to a plane which includes said elongated base member, said material fence member, and said coupler arm means.

5. The combination according to claim 4 further comprising indicia means on said elongated base member for indicating the angular degree of pivot between the first ends of said base member and said fence member.

6. The combination according to claim 5 wherein said elongated base member and said fence member have uniform cross sections throughout the lengths thereof.

7. The combination according to claim 6 wherein said elongated base member and said fence member are made of extruded material.

8. The combination according to claim 7 wherein said extruded material is aluminum.

9. The combination according to claim 8 wherein said elongated base member and said fence member are the same width in a direction parallel to said flat material-engaging surface of said fence member.

10. The combination according to claim 9 further comprising a friction producing surface on the flat material-engaging surface of said fence member.

11. The combination according to claim 1 further comprising:

a second track extending along a predetermined portion of the length of the base member on a side opposite of the first track;

guide bar means releaseably coupled to said second track for riding in miter slots of any one of a plurality of different tools for moving said angle attachment in a straight line; and attachment means coupled to said guide bar means for coupling said guide bar means to the base member.

12. The combination according to claim 11 wherein said guide bar means has a uniform cross section throughout the length thereof.

13. The combination according to claim 12 wherein said elongated base member, said material fence member and said guide bar means each are formed of elongated extrusions of material.

14. The combination according to claim 13 wherein said extruded material is aluminum.

15. The combination according to claim 1 further including a friction producing surface on the flat material-engaging surface of said fence member.

16. The combination according to claim 1 wherein said flat material-engaging surface of said fence member is perpendicular to a plane which includes said elongated base member, said material fence member, said coupler arm means.

17. The combination according to claim 16 wherein said elongated base member and said fence member are the same width in a direction parallel to said flat material-engaging surface of said fence member.

18. The combination according to claim 17 further comprising a friction producing surface on the flat material-engaging surface of said fence member.

19. The combination according to claim 1 wherein said elongated base member and said fence member are made of extruded material.

20. The combination according to claim 19 wherein said extruded material is aluminum.

* * * * *